US009610464B2

(12) United States Patent
Bigelow et al.

(10) Patent No.: US 9,610,464 B2
(45) Date of Patent: Apr. 4, 2017

(54) DEPLOYABLE, FOLDABLE SMOKE/FIRE CURTAIN ASSEMBLY

(71) Applicant: Smoke Guard, Inc., Boise, ID (US)

(72) Inventors: Orrin Bigelow, Haines, OR (US); Don Fasen, Boise, ID (US)

(73) Assignee: Smoke Guard, Inc., Boise, ID (US)

( * ) Notice: Subject to any disclaimer, the term of this patent is extended or adjusted under 35 U.S.C. 154(b) by 0 days.

(21) Appl. No.: 14/749,434

(22) Filed: Jun. 24, 2015

(65) Prior Publication Data

US 2015/0376897 A1 Dec. 31, 2015

Related U.S. Application Data

(63) Continuation of application No. 62/017,179, filed on Jun. 25, 2014.

(51) Int. Cl.

| | |
|---|---|
| ***A62C 2/10*** | (2006.01) |
| ***A62C 2/06*** | (2006.01) |
| *A62C 2/08* | (2006.01) |

(52) U.S. Cl.

CPC ..... *A62C 2/10* (2013.01); *A62C 2/06* (2013.01); *A62C 2/065* (2013.01); *A62C 2/08* (2013.01)

(58) Field of Classification Search

CPC .. A62C 2/10; A62C 2/06; A62C 2/065; A62C 2/08; E04B 1/94; E04B 1/941; E04B 1/943; E04B 1/944; E04B 1/946; E04B 1/947; E04B 2/7403

USPC ..... 160/41, 44, 121.1; 52/29

See application file for complete search history.

(56) References Cited

U.S. PATENT DOCUMENTS

| | | | | |
|---|---|---|---|---|
| 1,369,518 | A * | 2/1921 | Bumbarger | A62C 2/16 126/546 |
| 3,687,185 | A * | 8/1972 | Singer | A62C 2/10 160/1 |
| 4,077,474 | A * | 3/1978 | Hattori | A62C 2/10 160/1 |
| 5,195,594 | A * | 3/1993 | Allen | A62C 2/10 160/243 |
| 5,383,510 | A * | 1/1995 | Allen | A62C 2/10 160/243 |
| 5,862,851 | A * | 1/1999 | Stoebich | A62C 2/10 160/120 |
| 6,019,156 | A | 2/2000 | Wagner et al. | |
| 6,357,507 | B1 | 3/2002 | Stoebich et al. | |
| 6,484,784 | B1 | 11/2002 | Weik, III et al. | |
| 2003/0051829 | A1 * | 3/2003 | Sears | E06B 9/13 160/243 |
| 2005/0056383 | A1 | 3/2005 | Huang et al. | |

(Continued)

FOREIGN PATENT DOCUMENTS

| | | | | |
|---|---|---|---|---|
| DE | 2143470 | A1 * | 1/2010 | A62C 2/06 |
| ES | WO 2005102460 | A1 * | 11/2005 | A62C 2/10 |
| FR | 2208832 | A2 * | 7/2010 | A62B 3/00 |

OTHER PUBLICATIONS

"International Search Report & Written Opinion; PCT/US2015/037533; Mailing Date: Sep. 16, 2015; 11 Pages."

*Primary Examiner* — Babajide Demuren

(74) *Attorney, Agent, or Firm* — Perkins Coie LLP

(57) ABSTRACT

A multi-segmented, multi-plane, vertically deployable vapor and/or fire barrier assembly with a housing, a drive system, a folding barrier, a bottom plate, and motion sensors coupled to the bottom plate and coupled to a control system to detect operation and performance of the assembly, and related methods.

20 Claims, 12 Drawing Sheets

(56) References Cited

U.S. PATENT DOCUMENTS

| | | | | |
|---|---|---|---|---|
| 2005/0150664 | A1* | 7/2005 | Miller | A62C 2/10 169/45 |
| 2006/0150533 | A1* | 7/2006 | Lin | A62C 2/10 52/79.1 |
| 2007/0214885 | A1 | 9/2007 | Chernyak et al. | |
| 2009/0250174 | A1 | 10/2009 | Cloninger et al. | |
| 2010/0024992 | A1* | 2/2010 | Cloninger | A62C 2/10 160/311 |
| 2010/0243175 | A1* | 9/2010 | Gonzales | A62C 2/10 160/7 |
| 2013/0228289 | A1* | 9/2013 | Klish | E06B 9/82 160/7 |

* cited by examiner

DEPLOYABLE, FOLDABLE SMOKE/FIRE CURTAIN ASSEMBLY

CROSS-REFERENCE TO RELATED APPLICATION

This non-provisional utility patent application hereby claims the benefit of and priority to U.S. Provisional Patent Application No. 62/017,179, titled Deployable, Foldable Smoke/Fire Curtain Assembly, filed Jun. 25, 2014, which is incorporated herein by reference thereto.

TECHNICAL FIELD

Embodiments of the present invention are directed to smoke and/or fire barrier systems, and more particularly to deployable smoke and/or fire barrier assemblies and related methods.

BACKGROUND

Smoke, fumes, and noxious gases can be very dangerous to occupants during a building fire. It is well known that many fire-related deaths are the result of smoke inhalation. During a fire, or an event where smoke or other undesirable gases may be present, fumes are likely to travel very quickly through paths that offer little resistance. Paths such as elevator shafts, stairwells, atriums, or other open passageways between multiple floors of a building are often well drafted and provide an excellent avenue by which smoke and other undesirable gases can travel rapidly to otherwise unaffected areas of a building. To prevent such a migration of undesirable gases, many devices and assemblies have been designed to limit the vapor and/or fire dispersal by cutting off possible paths or openings. Examples of such devices are smoke screen assemblies disclosed in U.S. Pat. No. 5,383,510, entitled APPARATUS AND METHOD FOR RAPIDLY AND RELIABLY SEALING OFF CERTAIN OPENINGS IN RESPONSE TO SMOKE, NOXIOUS FUMES OR CONTAMINATED AIR, issued Jan. 24, 1995; U.S. Pat. No. 5,195,594, entitled APPARATUS AND METHOD FOR RAPIDLY AND RELIABLY SEALING OFF CERTAIN EXIT AND ENTRANCE WAYS IN RESPONSE TO SMOKE OR FIRE, issued Mar. 23, 1993; U.S. Pat. No. 7,000,668, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Feb. 21, 2006; U.S. Pat. No. 7,028,742, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Apr. 18, 2006; U.S. Patent Application No. 2006/0226103, entitled CLOSING MEMBER CONTROL SYSTEMS, INCLUDING DOOR CONTROL SYSTEMS FOR BARRIER HOUSINGS, AND ASSOCIATED METHODS, filed Oct. 12, 2006; and U.S. Provisional Patent Application No. 61/164,876, entitled BARRIER SYSTEMS AND ASSOCIATED METHODS, INCLUDING VAPOR AND/OR BARRIER SYSTEMS WITH MANUAL EGRESS, filed Mar. 30, 2009; each of which is incorporated herein by reference in its entirety.

SUMMARY

Aspects of the present disclosure are directed to a deployable smoke and/or fire barrier assembly having a foldable barrier that overcomes drawbacks experienced in the prior art and that provides other benefits. In at least one embodiment, the technology provides a deployable barrier assembly for use in a structure having a floor structure and a passageway having an outline. The assembly comprises a housing attachable to the structure above the floor structure in an arrangement with a shape substantially corresponding to the outline of the passageway. A barrier has top and bottom edge portions, and the top edge portion is retained in an interior area of the housing. The barrier being movable relative to the housing and the passageway between stowed and deployed positions. The barrier in the stowed position is substantially fully contained in the housing, and the barrier in the deployed position extends between the housing and the floor in an arrangement to close the passageway around the outline and block fire or vapor or both from entering the passageway. A bottom plate is connected to the bottom edge portion of the barrier and is engageable with the floor structure when the barrier is in the deployed position. The bottom plate is immediately adjacent to the housing when the barrier is in the stowed position with the barrier stacked supported atop the bottom plate. The bottom plate has a top surface facing the barrier, and the barrier is arranged with the barrier gathered atop the bottom plate when the barrier moves away from the deployed position. Flexible support members are connected to and carry the bottom plate. The flexible support members have bottom and top end portions, with the bottom end portions attached to the bottom plate adjacent to the barrier. A drive system has a rotatable drive shaft within the housing and a plurality of spools attached to the drive shaft. Each spool is connected to a respective one of the flexible support members and configured to wind the flexible support member onto the spool when the drive shaft is rotated in a first direction causing the barrier to move toward the stowed position, and configured to unwind the flexible support member from the spool when the drive shaft is rotated in a second direction causing the barrier to move toward the deployed position. A control system is operationally connected to the drive system and configured to control the drive system for movement of the barrier between the deployed and stowed positions. At least one motion sensor is attached to the bottom plate, and the motion sensor is operatively connected to the controller and configured to detect any change in motion of the bottom plate during movement of the barrier between the stowed, intermediate, and deployed positions and to provide one or more sensor signals to the controller indicating a change in the bottom plate's motion. The controller controls the drive system as a function of the sensor signals to control movement of the barrier between the stowed, intermediate and deployed positions.

In another embodiment, the technology provides a deployable vapor barrier assembly for use in a structure having a floor and a passageway. The assembly comprises a housing attachable to the structure and a barrier movable relative to the housing between stowed and deployed positions. The barrier in the stowed position is contained in the housing, and the barrier in the deployed position extends between the housing and the floor in an arrangement closing the passageway and blocking fire or vapor or both from entering the passageway. A bottom plate is connected to a bottom edge portion of the barrier, and the bottom plate is positionable adjacent to the floor when the barrier is in the deployed position. Portions of the barrier are gathered atop and carried by the bottom plate when in the intermediate and stowed positions. Flexible retraction members are connected to and carry the bottom plate. Bottom end portions of the retraction members are attached to the bottom plate. A drive system with a rotatable drive shaft and spools is attached to the drive shaft. The spools are connected to the retraction members and configured to wind the retraction members onto the spools causing the barrier to move toward the stowed position and configured to unwind the retraction members from the spools when causing the barrier to move toward the deployed position. A control system is coupled to the drive system and configured to control the drive system for movement of the barrier between the deployed and stowed positions. One or more motion sensors are attached to the bottom plate, and the motion sensors are coupled to the controller and configured to detect any change in motion of the bottom plate during movement of the barrier between the stowed, intermediate and deployed positions and to provide one or more sensor signals to the controller indicating a change in the bottom plate's motion. The controller controls the drive system as a function of the sensor signals to control movement of the barrier between the stowed, intermediate and deployed positions.

DETAILED DESCRIPTION

Various embodiments of the disclosure will now be described. The following description provides specific details for a thorough understanding and enabling description of these embodiments. One skilled in the art will understand, however, that the disclosure may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the disclosure. Certain terms may even be emphasized below; however, any terminology intended to be interpreted in any restricted manner will be overtly and specifically defined as such in this Detailed Description section. As used herein vapor includes gases or gases carrying particulates (e.g., solid and/or liquid particulates), such as smoke, fumes, smoke with soot particles, contaminated air, noxious fumes, and/or the like.

References throughout the specification to "one embodiment" or "an embodiment" means that a particular feature, structure, or characteristic described in connection with the embodiment and included in at least one embodiment of the present disclosure. Thus, the appearances of the phrase "in one embodiment" or "in an embodiment" in various places throughout the specification are not necessarily all referring to the same embodiment. Furthermore, the particular features, structures, or characteristics may be combined in any suitable manner in one or more embodiments.

Figure 1A:
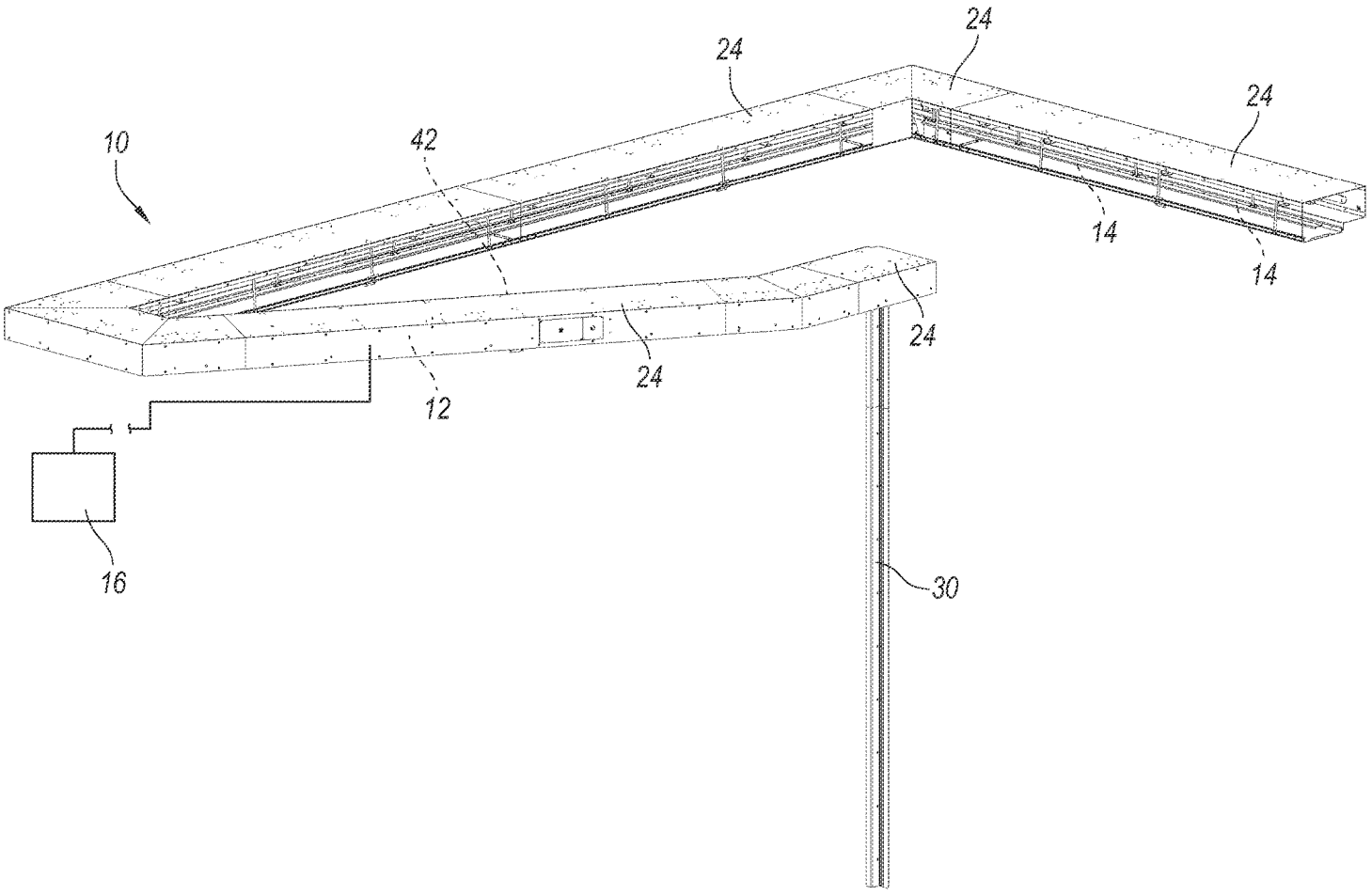
FIGS. 1A and 1B are isometric views of a barrier assembly in accordance with an embodiment of the present disclosure, wherein a fire and/or vapor barrier is in a stowed position.

FIGS. 1A-5 illustrate various features of a barrier assembly 10 in accordance with various embodiments of the present technology. FIGS. 1A and 1B are isometric views of a barrier assembly 10 with a vapor barrier 12 positioned in a housing 20 in a stowed position in accordance with at least one embodiment of the present technology. FIGS. 2A-2B are isometric views of the assembly 10 of FIG. 1A with the vapor barrier 12 shown in a deployed position. The illustrated assembly 10 is a vertically deployable, multi-plane, smoke and/or fire barrier assembly mountable to a structure 22, such as a ceiling structure of a multi-storage building. The assembly 10 is configured to be mounted around, as an example, a vertical passageway extending between floors of the building, such as a stairway, an atrium so as to partition the passageway from the rest of the floor in the event of a fire or other emergency condition. Accordingly, when the assembly 10 is deployed, it will block smoke, vapors, and/or fire from moving into or out of the vertical passageway. As discussed in greater detail below, the assembly 10 has a movable bottom plate 18 connected to the bottom portion of the barrier 12, and a plurality of movement and/or position sensors 14 are carried by the bottom plate 18. The sensors 14 are coupled to a control system 16 and configured to monitor movement of the bottom plate 18 and to provide a signal to the control system 16 if the bottom plate 18 impacts an unexpected obstruction or if the bottom plate's velocity changes prematurely during deployment, thereby indicating a non-standard condition. The sensors 14 and control system 16 can stop or change the barrier deployment so as to protect against the barrier from skewing during deployment and adversely affecting proper operation of the assembly.

As seen in FIGS. 1A-2B, the assembly 10 has a plurality of interconnected segments 24 disposed in one or more vertical planes. The segments 24 are arranged in a selected shape or configuration corresponding to the outline or "footprint" around the passageway to be sealed off upon deployment of the assembly 10. A variety of shape, or "footprints" can be used by interconnecting a plurality of the segments 24 in the desired arrangement to correspond to the shape of the selected passageway. Accordingly, the assembly 10 is a substantially modular system that can be constructed to match the needs of various passageway shapes for installation in a variety of buildings or other selected structures.

Figure 1B:
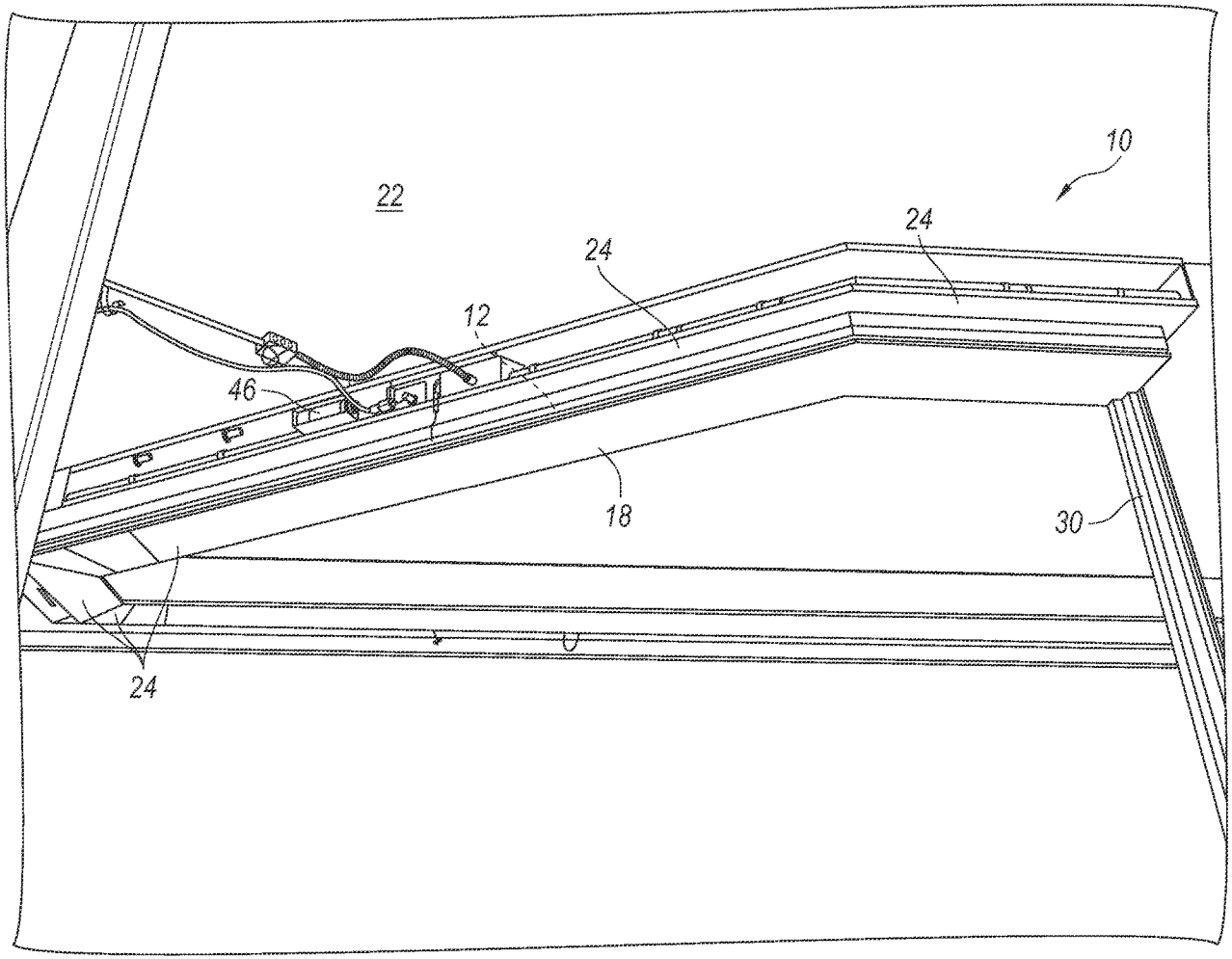
Figure 2A:
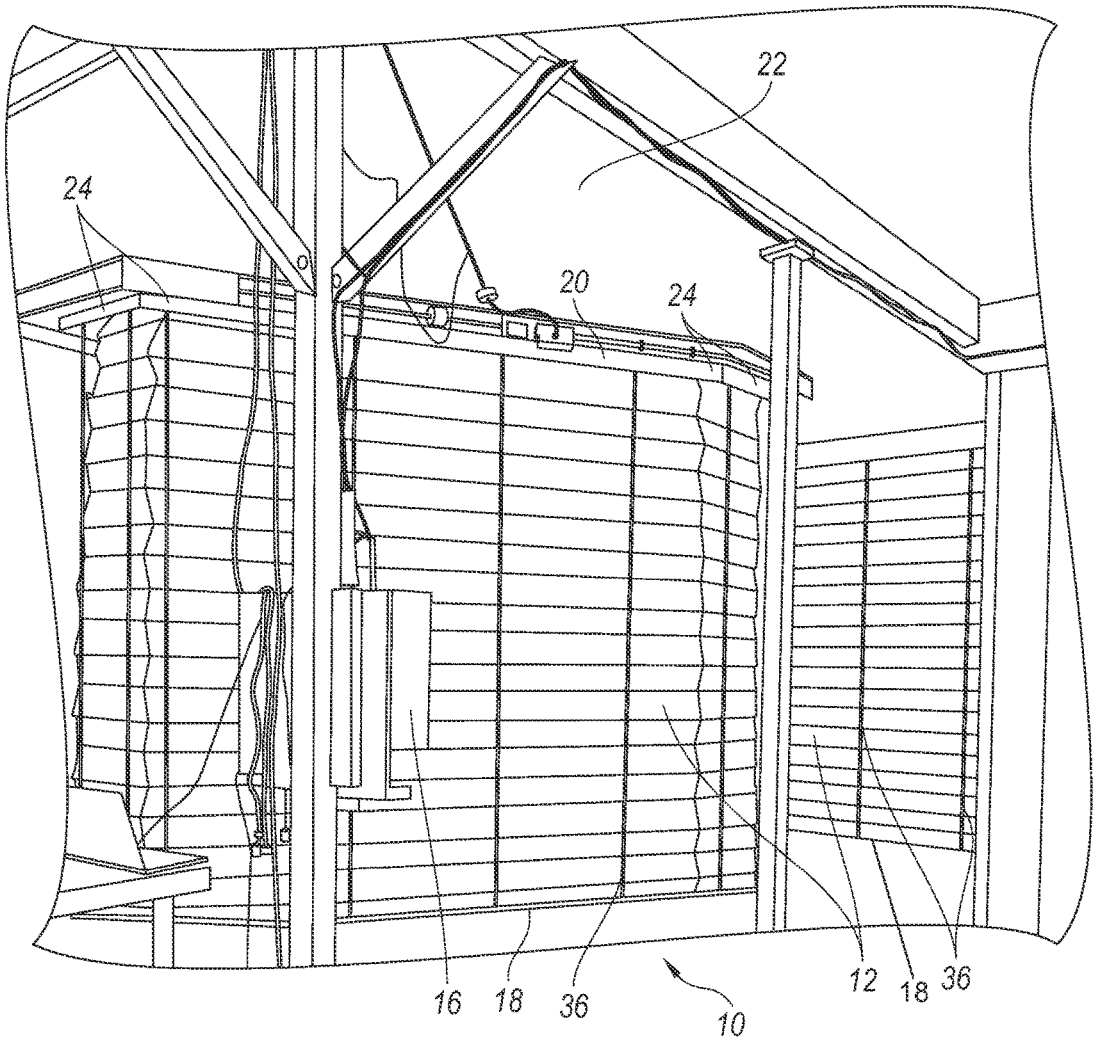
FIG. 2A is an isometric view of the barrier assembly of FIG. 1 with the fire and/or vapor barrier shown in a deployed position.
Figure 2B:
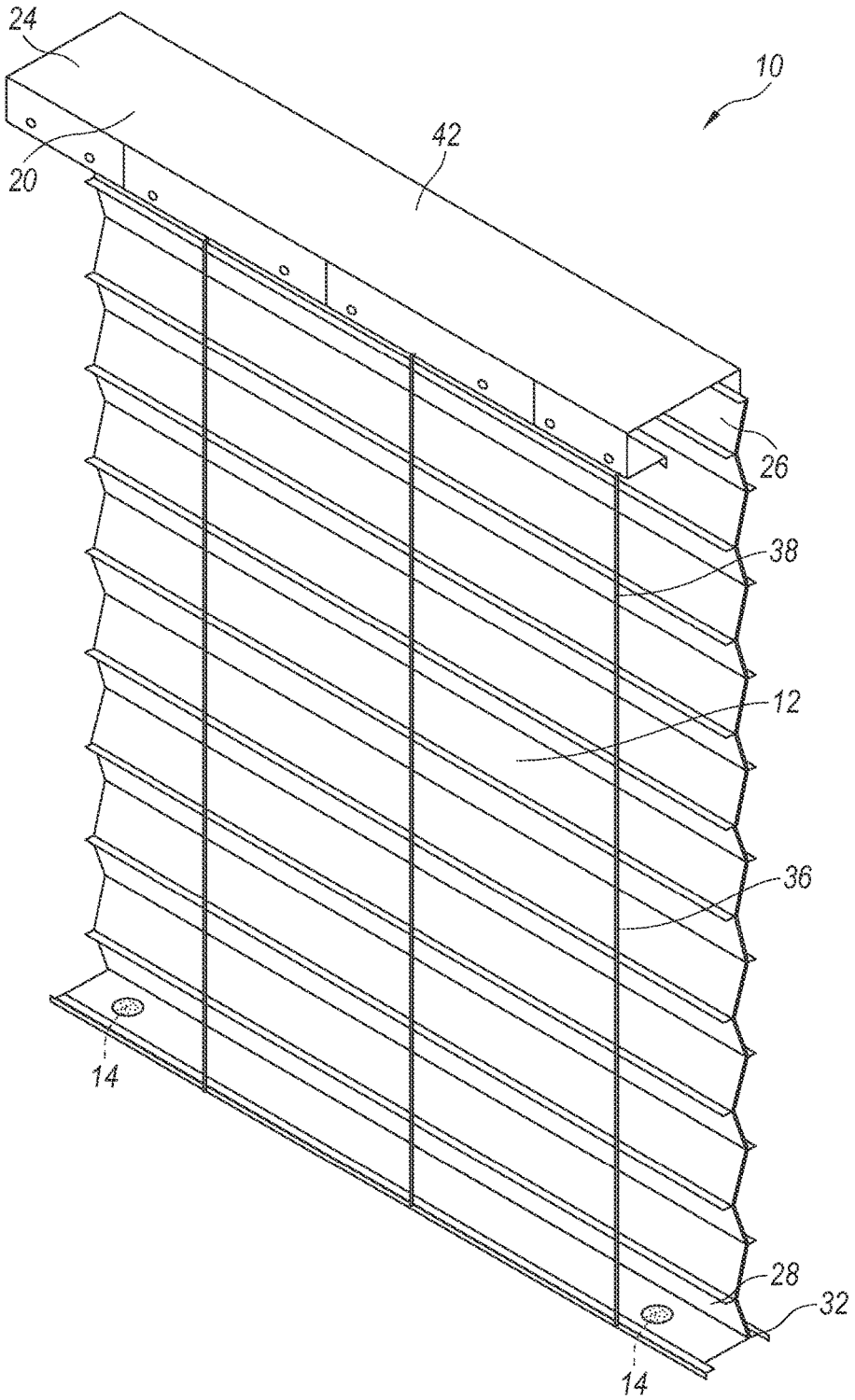
FIG. 2B is an isometric views of a segment of the barrier assembly of FIG. 2A shown in the deployed position.

As shown in FIGS. 1A and 1B, the vapor barrier 12 is contained in the housing 20 when the barrier is in a stowed position, as shown in FIGS. 1A-1B. When the barrier 12 is in the stowed position, the barrier is in an alternating folded configuration, such as an accordion fold similar to the deployable barrier fold arrangement as disclosed in European Patent Application No. 09008811.3, EP Publication No. 2 143 470A1, titled Fire Partition, which is incorporated herein by reference thereto. The barrier 12 is movable to a fully deployed position, as shown in FIGS. 2A-2B, wherein the barrier 12 unfolds so that the top edge portion 26 of the barrier 12 remains in the housing 20, and the barrier extends to the floor or ground. The bottom edge portion 28 of the barrier 12 is attached to the bottom plate 18, which is configured to substantially engage the ground/floor when the barrier 12 is in the fully deployed position, thereby blocking fire, smoke, or other vapors from passing under the deployed barrier 12.

The assembly 10 of the illustrated embodiment is shown with a vertically-oriented deployment guide 30 coupled to a side edge of the barrier 12. The deployment guide 30 can be securely attached at its upper end to the housing 20 and/or to the building structure to which the housing is connected. The bottom end of the deployment guide 30 is securely fixed to the floor of the associated structure. The deployment guide 30 may also be connected to a wall structure that securely retains the guide in its vertical orientation. The deployment guide 30 is configured to engage and retain a side edge of the barrier 12 as the barrier 12 moves between the stowed and deployed positions. When the barrier 12 is in the deployed position, the deployment guide 30 retains the barrier's side edge and blocks fire, smoke, or other vapors from passing around the side of the barrier. Although only one deployment guide 30 is shown in the Figures, other embodiments include a separate deployment guide for each side edge of the barrier 12. Although the illustrated embodiment shows an assembly 10 with a vertically deployed barrier 12, other embodiments can be configured to deploy the barrier 12 horizontally or in another non-vertical plane.

In selected embodiments the barrier 12 and assembly 10 can be configured so that the assembly 10 will meet various industry standards to qualify as a smoke partition, a fire partition, a fire barrier, a smoke barrier, and/or a fire wall (e.g., in accordance with standards associated with the International Building Code, International Code Congress, NPFA Life Safety Code, etc.). For instance, in one embodiment the barrier 12 can include a flexible and foldable material that includes fiberglass that has been impregnated and/or coated with a flouropolymer such as a polytetraflouroethylene (PTFE) (e.g., such as Teflon®). In selected embodiments, a PTFE-coated material suitable for use as a smoke barrier can include CHEMFAB® (e.g., with a thickness of 0.003 to 0.004 inches), available from Saint-Gobain Performance Plastics Corporation of Elk Grove Village, Ill. In other embodiments, the barrier 12 can have other configurations, including being made from other materials and/or having other thicknesses.

Figure 3A:
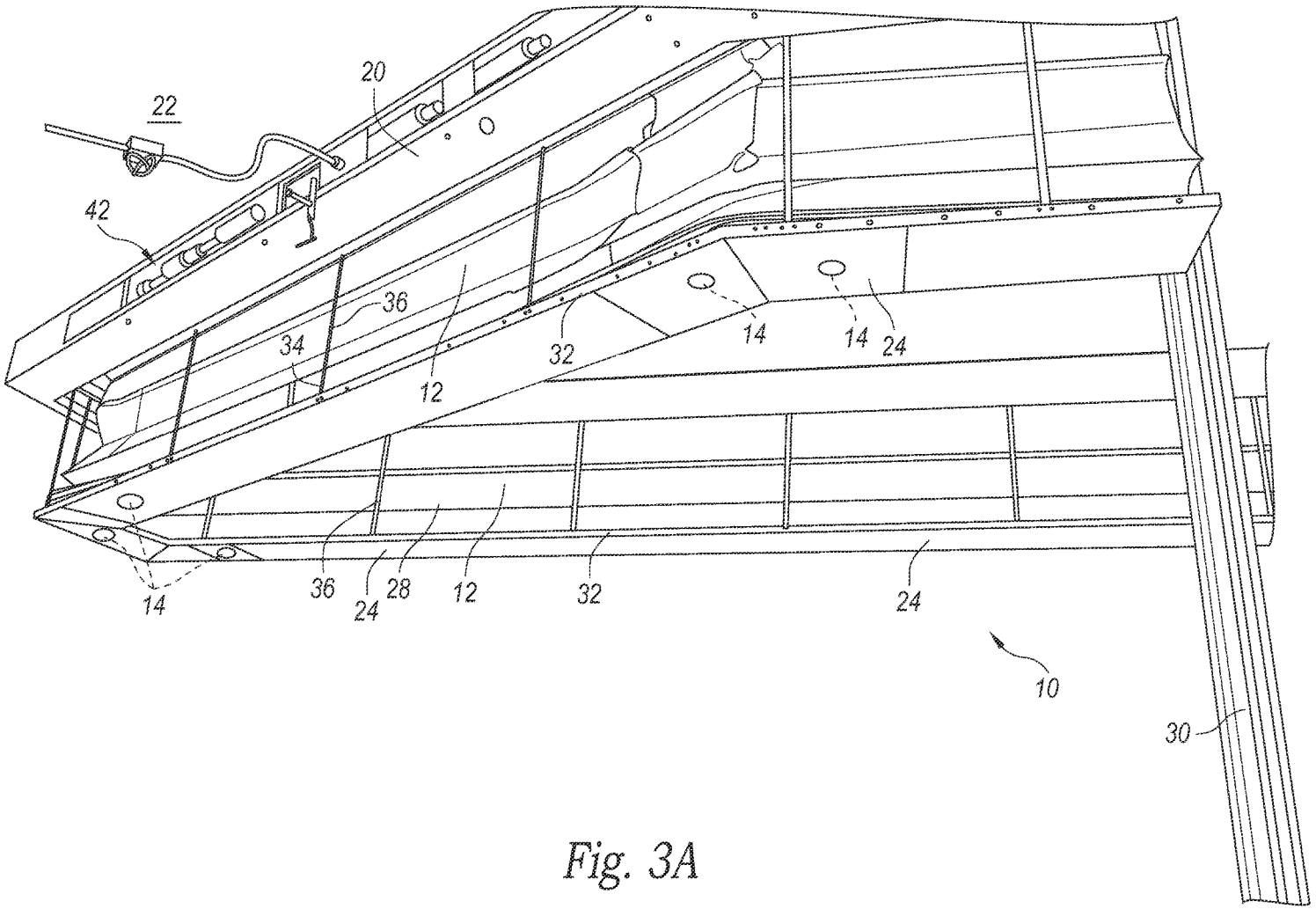
FIGS. 3A-3C are partial isometric views of the barrier assembly of FIG. 1A with the fire/vapor barrier shown in intermediate positions.
Figure 3B:
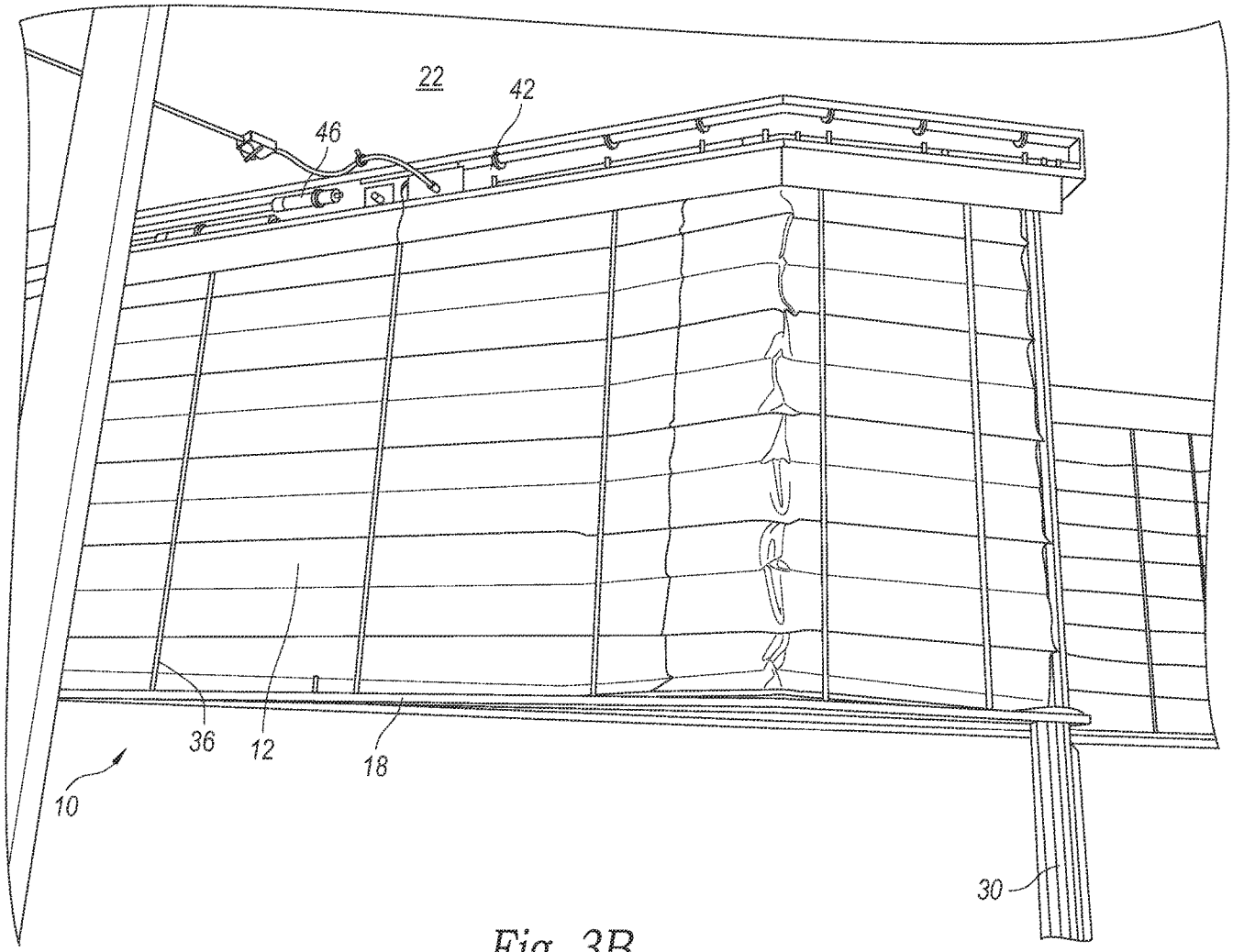
Figure 3C:
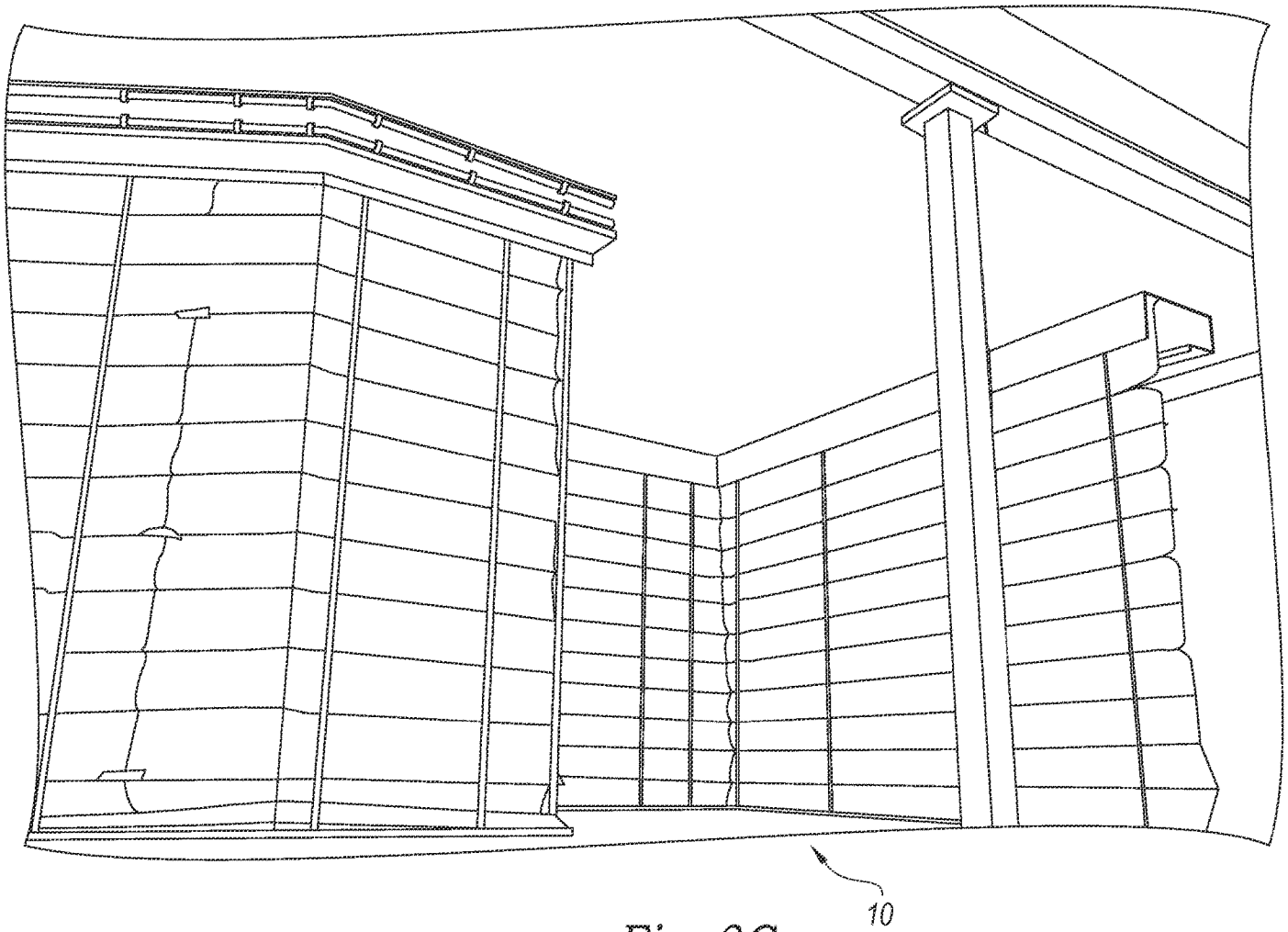

The bottom plate 18 of the illustrated embodiment is a metal plate with opposing front and rear flanges 32 spaced apart by a distance slightly greater than the width of the barrier 12 when folded. Accordingly, when the barrier 12 is retracted from the fully deployed position and moves through one or more intermediate positions (as shown in FIGS. 3A-3C) toward the stowed position, the barrier 12 folds in alternating directions and is gathered at least partially between the flanges 32 atop the bottom plate 18. When the barrier 12 is in the stowed position, the barrier 12 is stacked in the alternating folded configuration on the bottom plate 18 and is located within the housing with the bottom plate immediately adjacent to the bottom of the housing. Accordingly, the bottom plate 18 forms a close out along the bottom of the housing 20 that can protect and visually hide the folded barrier 12.

Figure 4A:
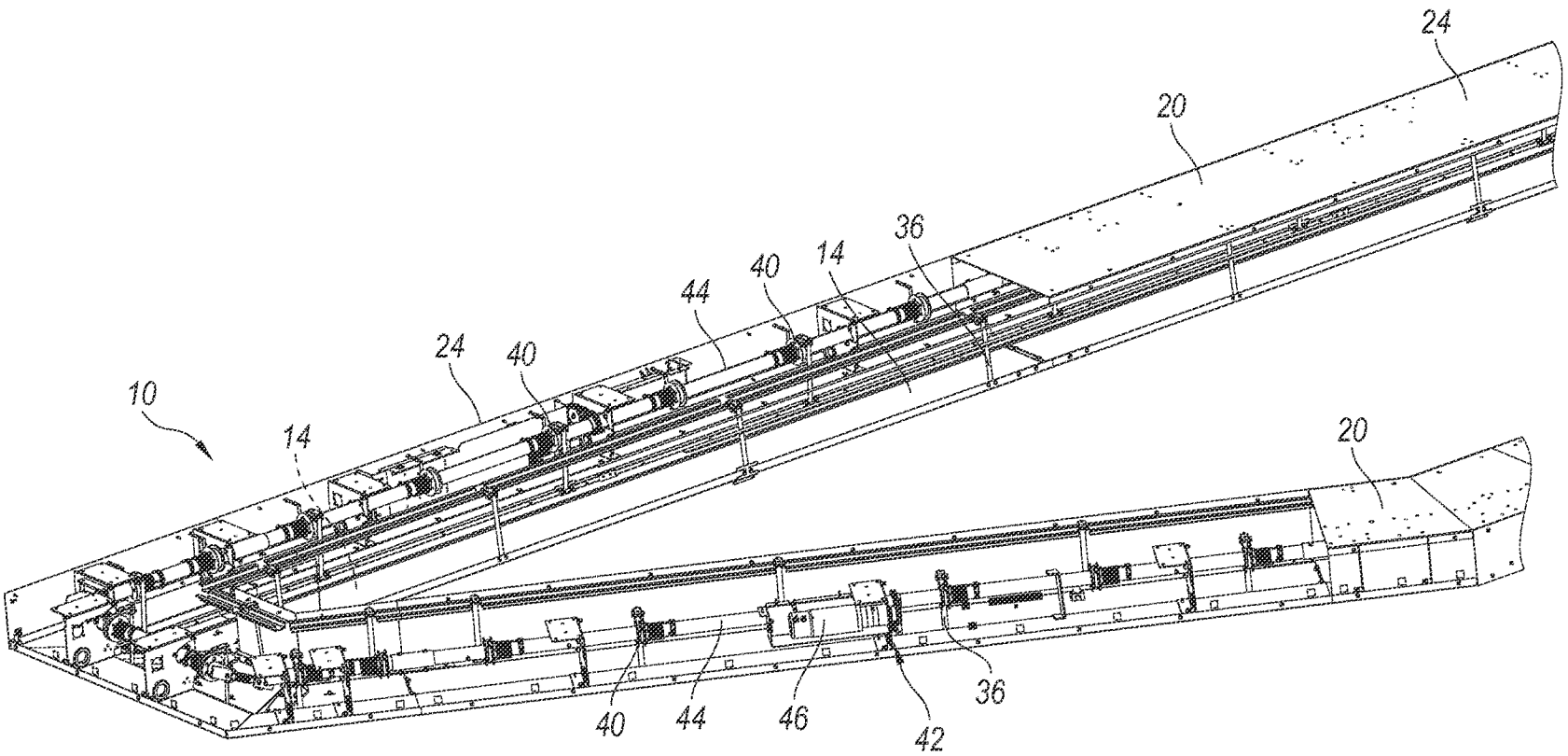
FIG. 4A is an enlarged isometric view of an upper portion of the barrier assembly of FIG. 1 with portions of a barrier housing, and the barrier not shown to illustrate a drive system in the housing.
Figure 4B:
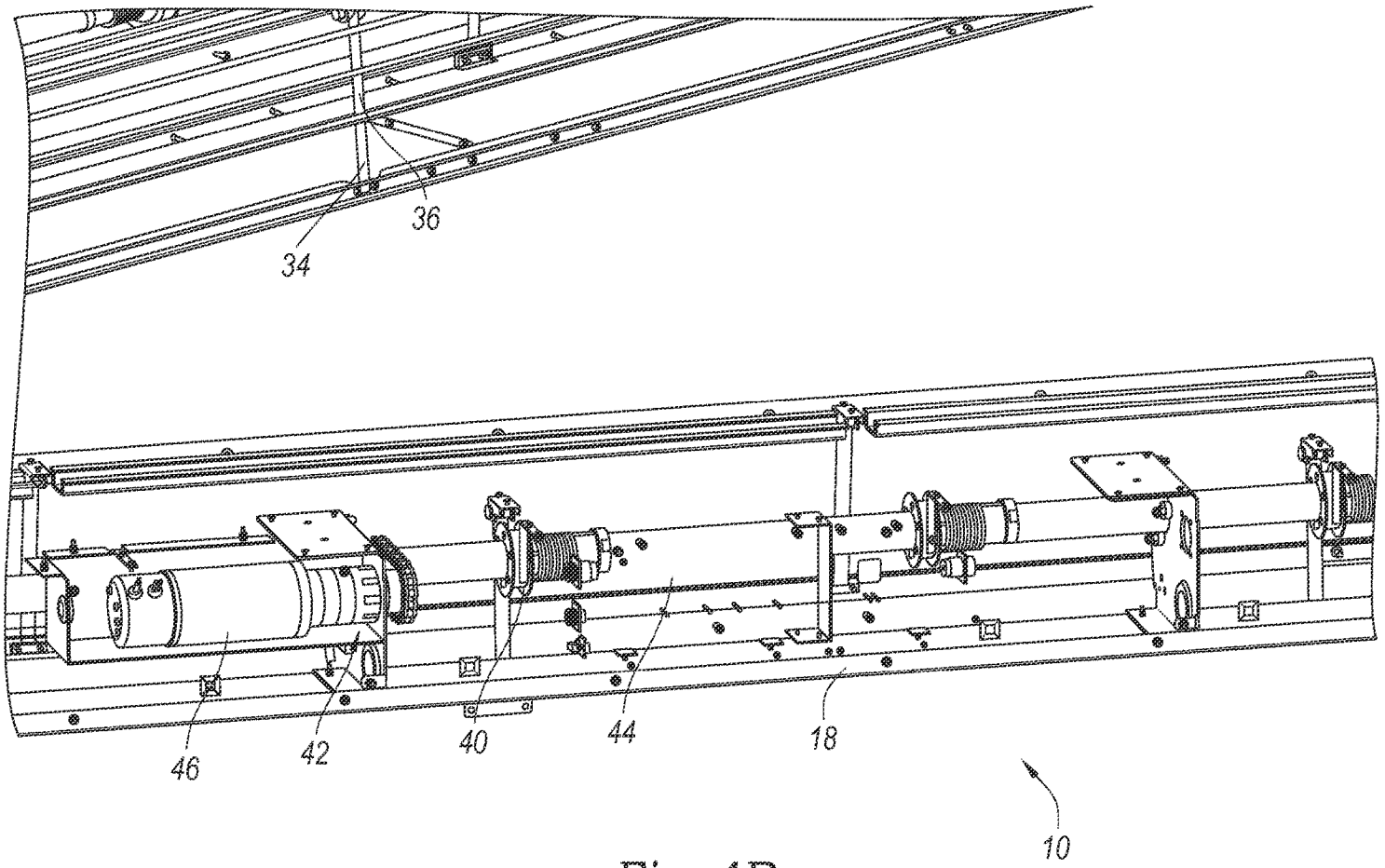
FIG. 4B is an enlarged partial isometric view of the barrier assembly of FIG. 4A and showing a portion of the drive system.

As shown in FIGS. 4A and 4B, the bottom plate 18 of the illustrated embodiment is connected to the bottom ends 34 of a plurality of alignment and retraction straps 36, which are connected at their respective top ends 38 to spools 40 of a drive system 42 contained in the housing 20. The barrier 12 is not shown in FIGS. 4A and 4B for purposes of clarity and to avoid obscuring of features of the drive system 42 from view. The spools 40 are connected to a drive shaft 44 coupled to one or more drive motors 46. The drive motor 46 is configured to rotate the drive shaft 44 and spools 40 in one direction, such that the retraction straps 36 will wind onto spools 40, thereby retracting the barrier 12 from the deployed or intermediate positions toward the stowed position. The drive motor 46 is also configured to actively or passively allow the drive shaft 44 and spools 40 to rotate the opposite direction, thereby lowering the bottom plate 18 and moving the barrier 12 toward the deployed position.

The drive system 42 is operatively connected to the control system 16 configured to command movement or operation of the drive system 42, which in turn can control movement of the barrier 12. The control system 16 can also be operably coupled to at least one external device associated with the assembly 10, such as a fire alarm/detector, a smoke alarm/detector, or an external monitoring system that monitors and displays the status of the assembly 10 (or provides remote control of the assembly 10).

In selected embodiments, the control system 16 can include a computing system or computer and can be configured with instructions to control the movement of the drive system 42, to control the movement of the barrier 12, to communicate with external devices, to perform various monitoring tasks, to perform various calibration tasks, to provide or display the status of at least a portion of the assembly 10, or the like. In certain embodiments, the control system 16 can include a display for displaying associated information and/or a control panel or key pad that allows a user to provide inputs to the control system 16 (e.g., to control the assembly 10). The assembly 10 can also include various pathways for communicating information between components, transferring power (e.g., electrical power), and/or the like. In selected embodiments, these pathways can include wires, connectors, fiber optic cables/devices, wireless communication devices, and/or the like.

The control system 16 can be configured to perform other functions, including supplying electrical power to other components (e.g., the control system 16 can supply power from a power supply to the external device), monitoring various barrier system components, monitoring external devices, and/or calibrating various components associated with the barrier system. For example, in certain embodiments the control system 16 can command the drive system 42 to enable movement or to move the barrier 12 toward the deployed and stowed positions based on the information provided by the sensors 14 on the bottom plate 18.

Referring again to FIGS. 1A, 1B, and 3A-3C, when the barrier 12 is in the deployed position (FIGS. 1A and 1B) or an intermediate position (FIGS. 3A-3C), the retraction straps 36 extend downwardly from the spools 40 of the front and rear sides of the barrier 12. These retraction straps 36 also act as barrier guides that help keep the folded portion of the barrier 12 stacked atop the bottom plate 18. The retraction straps 36 also help guide the barrier 12 atop the bottom plate 18 as the barrier moves toward the stowed position, folds in alternating directions, and stacks onto the bottom plate 18. In one embodiment, the retraction straps 36 are made of a concave metal strapping, similar to the strap portion of a conventional tape measure. In other embodiments, the retraction straps 36 can be cables or suitable materials that can accurately, uniformly, and/or consistently wind onto and off of the spools 40.

As indicated above, the illustrated assembly 10 has a plurality of segments 24, each of which includes interconnected and interconnectable segments of the housing 20, the barrier 12, the bottom plate 18, and the drive shafts 44 (with one or more spools 40 and retraction straps 36 thereon). In the illustrated embodiment, a single drive motor 46 is coupled to the plurality of operatively interconnected drive shafts 44 so all of the drive shafts and spools rotate simultaneously at the same rate upon activation of the drive motor 46. Accordingly, during normal operation the interconnected segments of the bottom plate 18 simultaneously move vertically at the same rate between the stowed and deployed positions without skewing.

In the illustrated embodiment, the bottom plate 18 is a generally planar member having a width sized to receive and/or support the folded portion of the barrier 12. When the barrier 12 is deployed, such as in response to a fire, smoke, or other identified emergency condition, the bottom plate 18 is released and drops away from the housing 20, so the barrier 12 unfolds and moves toward the deployed position. The bottom plate 18 will lower evenly and smoothly if it is uninterrupted until it reaches the floor/ground. If a portion of the bottom plate 18, however, impacts or engages an obstruction as the barrier 12 moves toward the deployed position, the bottom plate 18 could skew or tilt, which could put the retraction straps 36 and/or the barrier 12 out of balance relative to the rest of the assembly components and potentially cause deployment or other performance issues. The potential of the bottom plate 18 impacting an obstruction, such a person, misplaced furniture, or other portable structures or debris, is exacerbated because of the length and width of the bottom plate segments. To eliminate these issues with the bottom plate 18 should it strike an obstruction during deployment (or during retraction toward the stowed position), the assembly 10 includes the plurality of motion sensors 14 (FIG. 5) connected to the bottom plate segments and operatively coupled to the control system 16.

Figure 5:
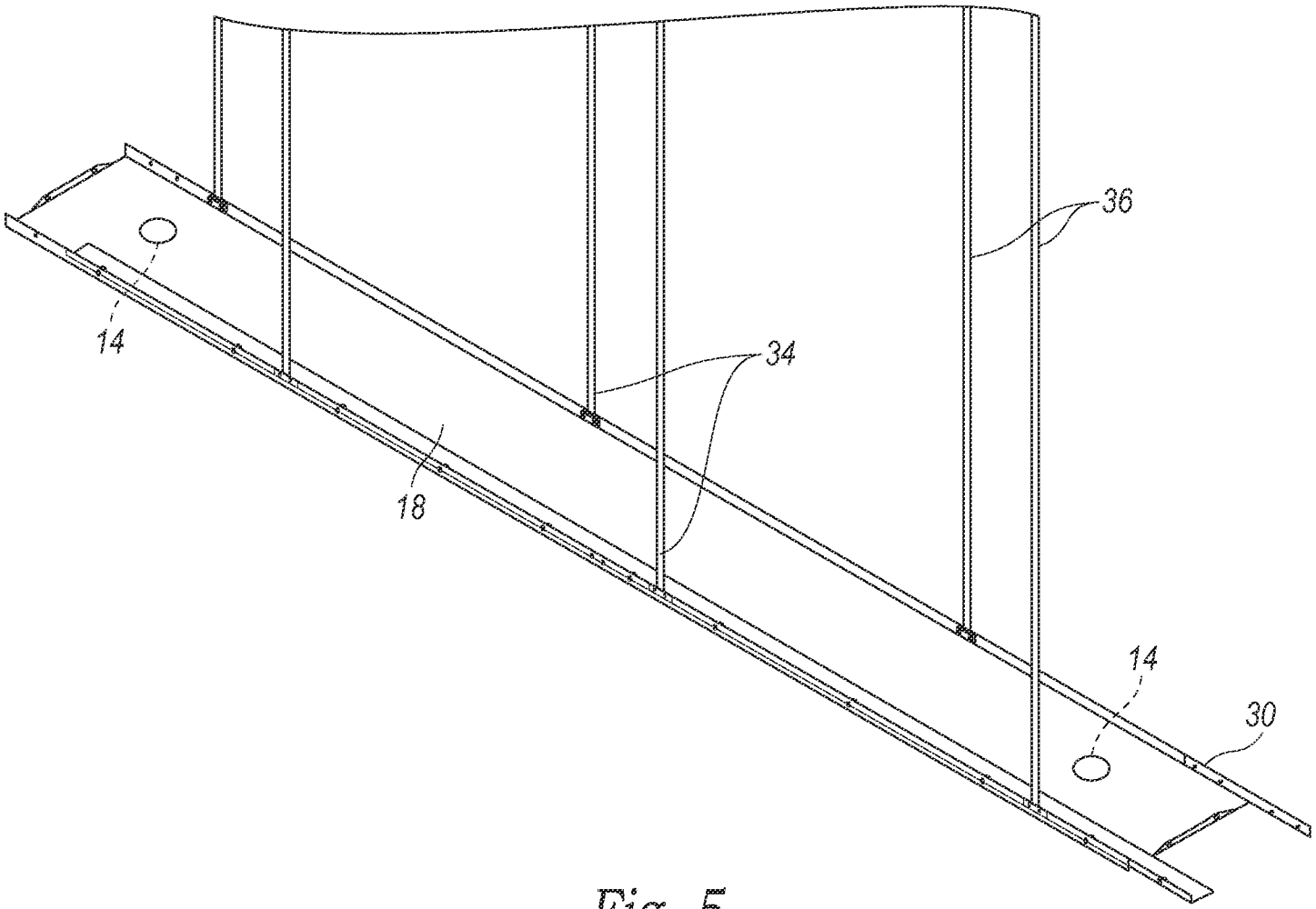
FIG. 5 is an enlarged isometric view of a bottom plate of the assembly of FIG. 2B with motion sensors positioned on the bottom plate.

In the embodiment illustrated in FIG. 5, at least one motion sensor 14 is attached to a top surface of each segment of the bottom plate 18 substantially along the bottom plate's centerline. Other embodiments can include the motion sensors 14 attached at other locations on the bottom plate 18. The motion sensors 14 can be positioned so they are covered and protected by the barrier when folded and stacked atop the bottom plate 18, such as in the stowed position. The motion sensors 14 are configured to detect virtually any change in the speed or motion of any portion of the respective bottom plate segment during deployment and/or retraction. In one embodiment, the motion sensors 14 can be very accurate accelerometers, such as accelerometers manufactured by Kionix Inc, of Ithaca, N.Y.

Figure 6:
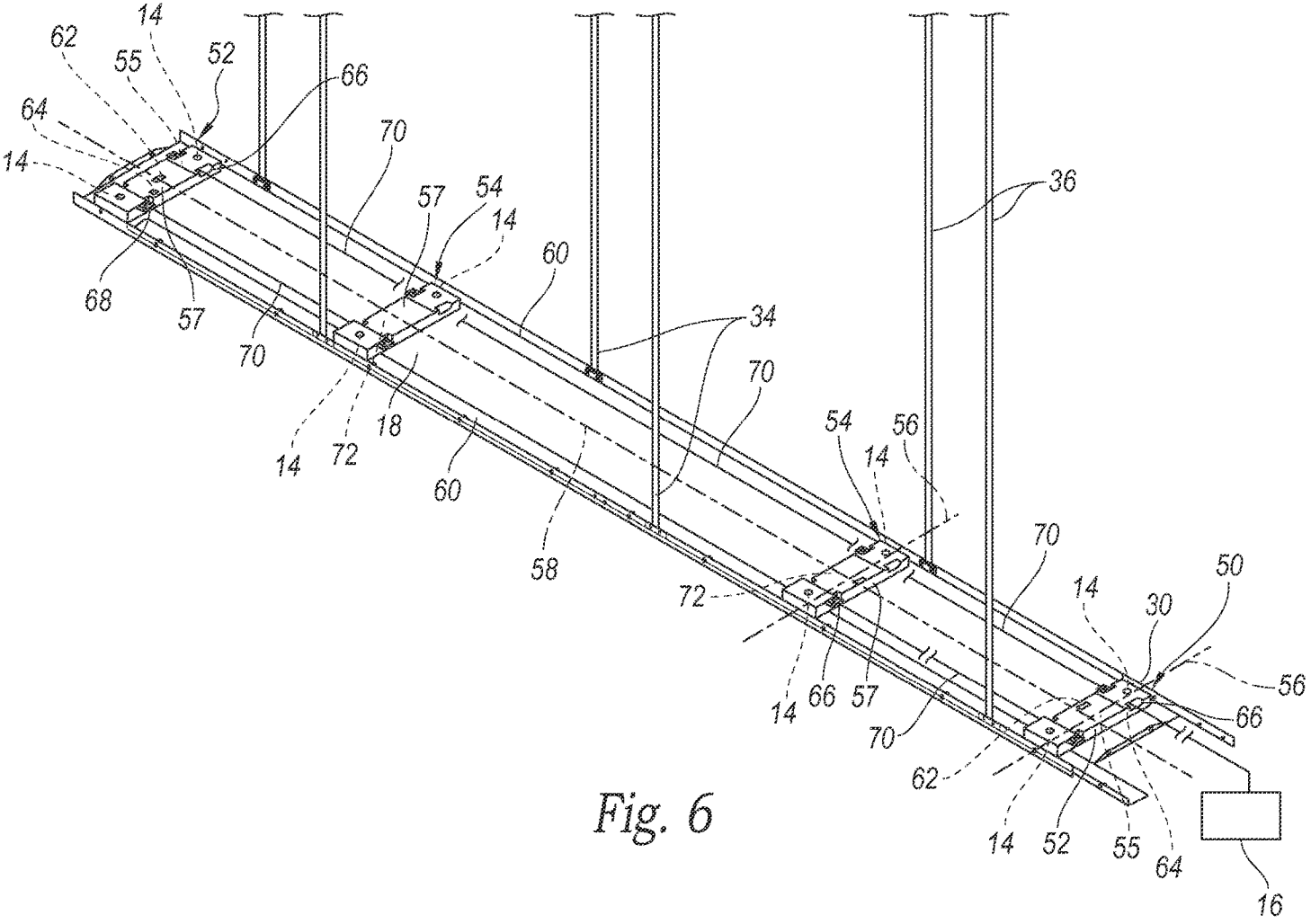
FIG. 6 is an enlarged isometric view of a bottom plate and sensor assemblies of an assembly in accordance with another embodiment of the present technology

FIG. 6 is an enlarged isometric view of another embodiment of the assembly, wherein a plurality of sensor assemblies 50 are attached to the bottom plate 18. The sensor assemblies 50 include a plurality of motion sensors 14 configured to detect virtually any change in the speed or motion of any portion of the respective bottom plate segment during deployment and/or retraction. The sensor assemblies 50 include master sensor assemblies 52 each connected to one or more satellite sensor assemblies 54 spaced apart from its respective master sensor assembly 52. In the illustrated embodiment, the satellite sensor assembly 44 is spaced apart from its respective master sensor assembly 52 by a selected distance, such as approximately 1-4 feet, although other arrangements can be used. Each of the master and satellite sensor assemblies 52 and 54 include at least a pair of motion sensors 14 carried on opposing end portions of a printed circuit board 55 or other support structure, such that the motion sensors 14 are generally aligned with or adjacent to a longitudinal axis 56 of the sensor assembly 52/54. The sensor assemblies 52/54 each have a housing 57 that covers and protects the printed circuit board 55 and the motion sensors 14.

The sensor assemblies 52/54 are secured to the bottom plate with the longitudinal axes 56 substantially normal to the longitudinal axis 58 of the bottom plate, such that the motion sensors 14 of each sensor assembly 52/54 are on opposing sides of the bottom plate's longitudinal axis 58. In the illustrated embodiments, the sensor assemblies 52/54 are configured so motion sensors 14 are positioned generally adjacent to the outer edge portions 60 of the bottom plate 18 away from the bottom plate's longitudinal axis 58. In other embodiments, the sensor assemblies 52/54 can be positioned so the longitudinal axes 56 are skewed or even parallel to the bottom plate's longitudinal axis 58.

Figure 7:
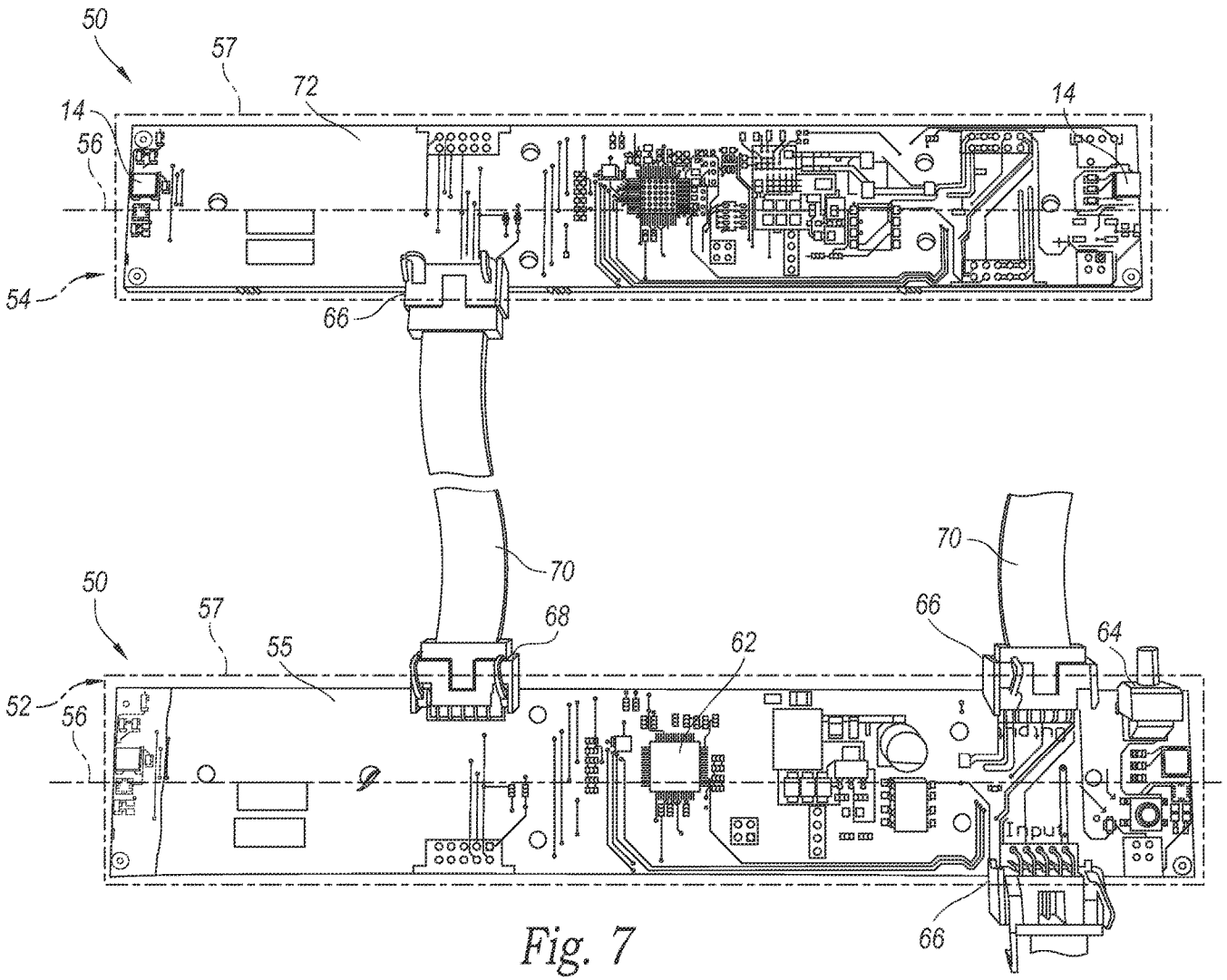
FIG. 7 is an enlarged isometric views of the master and satellite sensor assemblies of FIG. 6.

As seen in FIG. 7, each master sensor assembly 52 includes a microcontroller 62 connected to the motion sensors 14. The microcontroller 62 is coupled to the control system 16, such data from the sensors 14 related to the movement of the bottom plate 18 is provided to the microcontroller 62 and/or the control system 16. Each master sensor assembly 52 and also include a sensitivity switch 64 coupled to the motion sensors 14 and the microcontroller 62. The sensitivity switch 64 is configured to allow a user to adjust the sensitivity of the motion sensors 14 for detecting changes related to movement of the bottom plate 18. The master sensor assemblies 52 each also include one or more master connectors 66 and satellite connectors 68 that receive mating connectors of a data bus 70 or the like to connect each satellite sensor assembly 54 to its respective master sensor assembly 52, and to interconnect the master sensor assemblies 52 together.

In the illustrated embodiment, each satellite sensor assembly 52 also includes a support structure, such as a printed circuit board 72, that carries the spaced-apart motion sensors 14. A master connector 66 on the printed circuit board 72 is connected to the motion sensors 14 and is configured to connect to a data bus 70 that connects to the satellite connector 68 on the respective master sensor assembly 52. Accordingly, data from one or both of the motion sensors 14 of the satellite sensor assembly 54 can be provided to the microcontroller 66 of the respective master sensor assembly 52. In at least one embodiment, the satellite sensor assembly 54 is a "dumb sensor assembly" (i.e., without a microprocessor) that provides sensor data to the microcontroller of the respective master sensor assembly 52 and that receives power from the master sensor assembly 52. Accordingly, the satellite sensor assembly 54 is electrically less complicated and less expensive than the master sensor assembly 52.

In the illustrated embodiment, the combination of the master and respective satellite sensor assemblies 52 and 54 provides an array of four motion sensors 14 monitored by the microcontroller 62 and/or the control system 16 to detect movement of the sensors 14 and the associated bottom plate 18 as the barrier 12 moves between the deployed and retracted positions. The array of four motion sensors 14 in a fixed position relative to a portion of bottom plate 18 can be monitored to determine the movement of the motion sensors 14 relative to each other to detect, as an example, any rotational motion of the portion of the bottom plate about an axis parallel to the bottom plate's longitudinal axis 58, about an axis parallel to the sensor assemblies' longitudinal axis 56, about an axis normal to the bottom plate, and/or any combination of the above. Although the illustrated embodiment shows the four sensors in the combination of the master and satellite sensor assemblies 52/54, other embodiments can use a greater or fewer number of sensors 14. The microcontrollers 62 and/or the control system 16 is configured to monitor any relative motion of the sensor assemblies' sensor array and to determine whether the movement exceeds established threshold values. If the threshold values are exceed, the control system 16 can cause the drive system 42 to halt movement of the barrier, to change direction of the barrier, to pause and resume movement of the barrier, to abort movement of the barrier, any combinations of the above movements, or other selected movement instructions.

The motion sensors 14 can be multi-axis sensors configured to detect motion or motion change relative to more than one axis, or the sensors 14 may be single-axis sensors configured to detect motion or motion change in a single axis, such as the vertical axis. The motion sensors 14 can also be shrouded or otherwise sealably enclosed in a fireproof material capable of withstanding fire conditions for at least a selected period of time. As a result, these fireproofed sensors can continue to provide information to the control system 16 during a full fire condition. The fireproofed sensors can also be used in or as part of a smoke/fire certification testing process for the assembly. Accordingly, the assembly in accordance with embodiments of the present technology are unlike conventional fire barrier systems wherein elongate strip switches on the bottom surface of the bottom bar are not fireproof and must be removed prior to fire certification tests to avoid destroying the sensors.

In the illustrated embodiment, the plurality of master sensor assemblies 52 are interconnected in a series arrangement with a power and data bus also operatively connected to the control system 16 via flexible wires and/or other communication lines 54 that extend through the barrier 12, such as along a seam or the other passageway between the top and bottom edge portions 26 and 28 of the barrier 12. In another embodiment the plurality of master sensor assemblies 54 can be connected to the control system 16 in a parallel configuration. As indicated above, each satellite sensor assembly 54 is connected only to its respective master sensor assembly 52, and thereby coupled to the control system 16. Although the illustrated embodiments show sensor assemblies 50 and associated sensors 14 hardwired between themselves and to the control system, in other embodiments, the sensor assemblies 50 and the associated sensors 14 may be operatively connected to the control system 16 via a radio frequency network based upon a selected communication standard, such as Wi-Fi, 802.14.5, Bluetooth, Zigbee, etc., (sometimes referred to as a "wireless communication system"), so as to avoid the wires extending through the barrier. The control system 16 is configured to receive a signal from one or more sensor assemblies 50 related to data received from one or more of the sensors 14 indicating a change in the bottom plate's motion, such as upon impacting an obstruction. The control system 16 can immediately provide a signal or instructions to the drive system 42 to stop deployment or retraction of the barrier of, thereby avoiding the bottom plate 18, the barrier 12, the retraction straps 36, and/or other assembly components from becoming misaligned or out of balance.

The control system 16 may also be configured to perform a selected obstruction procedure, such as returning the barrier 12 to the stowed position or retracting the barrier 12 toward the stowed position a short distance and then continue the deployment process to allow the barrier to move to the fully deployed position. If the bottom plate 18 then impacts the same or another obstruction as indicated by one or more of the sensors 14, the control system 16 can perform an abort sequence in which the barrier 12 may be stopped in place in an intermediate position or retracted to the stowed position. These are only a couple of potential operational sequence examples, although the control system 16 may be configured with other selected operational sequences related to signals received from one or more sensors 14.

In addition to the sensors 14 and control system 16 being used for operational sequences as discussed above, the sensors 14 and control system 16 can also be configured to monitor the motion and operation of the bottom plates 18 during activation of the assembly 10, such as during periodic system tests and/or certification processes. The control system 16 can collect and compare data from some or all of the sensors 14 to determine the health and/or condition of assembly's components. The control system 16 may receive and determine whether the data from the sensors 14 suggest any potential degradation or excessive wear of selected components in the assembly 10. For example, one or more sensors 14 may indicate a slight performance change based upon the motion or rate of motion of a bottom plate segment or part of a bottom plate segment. This detected slight performance change could indicate abnormal wear or operation of an associated retraction strap 36, or an associated spool 40 or segment of the drive shaft 44. In response, the control system 16 could provide an indicator signal to a user to inspect or service portions of the assembly 10 to ensure that the assembly 10 remains in proper operational condition.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the following claims.

We claim:

1. A deployable barrier assembly for use in a structure having a floor structure and a passageway having an outline, comprising:

a housing attachable to the structure above the floor structure in an arrangement with a shape substantially corresponding to the outline of the passageway, the housing having an interior area;

a barrier having a top edge portion retained in the housing, a bottom edge portion, the barrier being movable relative to the housing and the passageway between stowed and deployed positions, the barrier in the stowed position being substantially fully contained in the housing, and the barrier in the deployed position extending between the housing and the floor in an arrangement to close the passageway around the outline and block fire or vapor or both from entering the passageway;

a bottom plate connected to the bottom edge portion of the barrier, the bottom plate being engageable with the floor structure when the barrier is in the deployed position, the barrier being supported atop the bottom plate when the barrier is in the stowed position, the bottom plate having a top surface facing the barrier, the barrier being arranged wherein the barrier gathers atop the bottom plate when the barrier moves away from the deployed position;

flexible support members connected to and carrying the bottom plate, the flexible support members having bottom and top end portions, the bottom end portions being attached to the bottom plate adjacent to the barrier;

a drive system with a rotatable drive shaft within the housing and a plurality of spools attached to the drive shaft, each spool being connected to a respective one of the flexible support members and configured to wind the flexible support member onto the spool when the drive shaft is rotated in a first direction causing the barrier to move toward the stowed position and configured to unwind the flexible support member from the spool when the drive shaft is rotated in a second direction causing the barrier to move toward the deployed position;

a control system operationally connected to the drive system and configured to control the drive system for movement of the barrier between the deployed and stowed positions; and at least one motion sensor attached to the bottom plate, the motion sensor being operatively connected to the controller and being configured to detect any change in motion of the bottom plate during movement of the barrier between the stowed, intermediate and deployed positions and to provide one or more sensor signals to the controller indicating a change in the bottom plate's motion;

wherein the controller controls the drive system as a function of the sensor signals to control movement of the barrier between the stowed, intermediate and deployed positions.

2. The assembly of claim 1 wherein the barrier has a side edge portion extending between the top and bottom edge portions, and the assembly further comprising a deployment guide in engagement with the side edge portion of the barrier, the side edge portion being retained in and movable within a portion of the deployment guide as the barrier moves between the stowed and deployed position.

3. The deployable barrier assembly of claim 1 wherein the motion sensor is attached to a top surface of the bottom plate and is covered by a folded bottom portion of the barrier supported on the bottom plate when the barrier is in the stowed and intermediate positions.

4. The deployable barrier assembly of claim 1 wherein the motion sensor is sealably encapsulated in a fire resistant material.

5. The deployable barrier assembly of claim 1 wherein the motion sensor is configured to detect a change in angular orientation of a portion of the bottom plate in the event the bottom plate impacts an obstruction.

6. The deployable barrier assembly of claim 1, further comprising a plurality of sensor assemblies that each include one or more motion sensors, wherein the sensor assemblies are fixed to the bottom plate, and the sensor assemblies comprise a plurality of master sensor assemblies each with a first pair of motion sensors positioned away from a longitudinal axis of the bottom plate, and a plurality of satellite sensor assemblies each with a second pair of motion sensors positioned away from the longitudinal axis of the bottom plate, wherein each satellite sensor assembly is connected to a respective one of the master sensor assemblies, and each of the master sensor assemblies has a microcontroller operatively coupled to the control system.

7. The deployable barrier assembly of claim 6, wherein the plurality of master sensor assemblies are interconnected with each other in a serial configuration along the bottom plate.

8. The deployable barrier assembly of claim 1 wherein the motion sensor is an accelerometer.

9. The deployable barrier assembly of claim 1 wherein the housing comprises a plurality of interconnected housing segments, the barrier having a plurality of interconnected barrier segments corresponding to the housing segments, the drive system having a drive motor and a plurality of interconnected draft shaft segments, each drive shaft segment carrying a plurality of spools and being contained in a respective one of the housing segments, and the drive motor connected to the plurality of interconnected drive shaft segments, wherein the drive motor is connected to the control system.

10. The deployable barrier assembly of claim 9 wherein adjacent interconnected housing segments and corresponding adjacent interconnected barrier segments and interconnected drive shaft segments position in an angled, non-linear orientation relative to each other.

11. The deployable barrier assembly of claim 1 wherein the flexible support members are flexible straps.

12. A deployable vapor barrier assembly for use in a structure having a floor and a passageway, comprising:

a housing attachable to the structure;

a barrier movable relative to the housing between stowed and deployed positions, the barrier in the stowed position being contained in the housing, and the barrier in the deployed position extending between the housing and the floor in an arrangement closing the passageway and blocking fire or vapor or both from entering the passageway;

a bottom plate connected to a bottom edge portion of the barrier, the bottom plate being positionable adjacent to the floor when the barrier is in the deployed position, portions of the barrier being gathered atop and carried by the bottom plate when in the intermediate and stowed positions;

flexible retraction members connected to and carrying the bottom plate, bottom end portions of the retraction members being attached to the bottom plate;

a drive system with a rotatable drive shaft and spools attached to the drive shaft, the spools being connected to the retraction members and configured to wind the retraction members onto the spools causing the barrier to move toward the stowed position and configured to unwind the retraction members from the spools when causing the barrier to move toward the deployed position;

a control system coupled to the drive system and configured to control the drive system for movement of the barrier between the deployed and stowed positions; and at least one motion sensor attached to the bottom plate, the motion sensor being coupled to the controller and being configured to detect any change in motion of the bottom plate during movement of the barrier between the stowed, intermediate and deployed positions and to provide one or more sensor signals to the controller indicating a change in the bottom plate's motion;

wherein the controller controls the drive system as a function of the sensor signals to control movement of the barrier between the stowed, intermediate and deployed positions.

13. The deployable barrier assembly of claim 12 wherein the bottom plate has a top surface facing the barrier and a longitudinal centerline, the motion sensors are attached along the longitudinal centerline on the top surface.

14. The deployable barrier assembly of claim 12 wherein the bottom plate has a top surface facing the barrier and the motion sensor is attached to the top surface and is covered by a folded bottom portion of the barrier supported on the bottom plate when the barrier is in the stowed and intermediate positions.

15. The deployable barrier assembly of claim 12 wherein the motion sensor is sealably encapsulated in a fire resistant material.

16. The deployable barrier assembly of claim 12 wherein the motion sensor is configured to detect a change in angular orientation of a portion of the bottom plate in the event the bottom plate impacts an obstruction during movement between the stowed and deployed positions.

17. The deployable barrier assembly of claim 12, further comprising a plurality of sensor assemblies that each include one or more motion sensors, wherein the sensor assemblies are fixed to the bottom plate, and the sensor assemblies comprise a plurality of master sensor assemblies each with a first pair of motion sensors positioned away from a longitudinal axis of the bottom plate, and a plurality of satellite sensor assemblies each with a second pair of motion sensors positioned away from the longitudinal axis of the bottom plate, wherein each satellite sensor assembly is connected to a respective one of the master sensor assemblies, and each of the master sensor assemblies has a microcontroller operatively coupled to the control system.

18. The deployable barrier assembly of claim 17, wherein the plurality of master sensor assemblies are interconnected with each other in a serial configuration along the bottom plate.

19. A multi-segmented, multiplane deployable smoke and fire barrier assembly for use in a structure having a floor structure and a passageway having a non-linear outline, comprising:

a housing assembly attachable to the structure above the floor structure in an arrangement with a shape substantially corresponding to the outline of the passageway, the housing assembly having a plurality of interconnected housing segments each having an interior area;

a vapor barrier assembly having a plurality of interconnected barrier segments having top and bottom edge portions, the top edge portions being retained in the interior areas of the housing segments, the barrier assembly being movable relative to the housing assembly between stowed and deployed positions, the barrier assembly in the stowed position being substantially fully contained in the housing assembly, and the barrier segments in the deployed position arranged in multiple non-linear vertically oriented planes and extending between the housing and the floor in an arrangement to close the passageway around the outline and block fire or vapor or both from entering the passageway, at least one of the barrier segments having a side edge portion extending between the top and bottom edge portions;

a bottom plate assembly having a plurality of bottom plate segments connected to the bottom edge portions of the barrier segments, the bottom plate segments being engageable with the floor structure in an arrangement corresponding with the outline when the barrier assembly is in the deployed position, each bottom plate segment being immediately adjacent to a respective one of the housing segments when the barrier assembly is in the stowed position with the barrier segments stacked and supported atop the bottom plate segments, the bottom plate segments each having a top surface facing the corresponding barrier segment, the barrier segments being arranged to gather atop the bottom plate segments when the barrier assembly moves away from the deployed position;

a deployment guide in engagement with the side edge portion of the at least one of the barrier segments, the side edge portion being movable within a portion of the deployment guide as the vapor barrier assembly moves between the stowed and deployed position, the deployment guide being substantially vertically oriented and substantially normal to the housing assembly;

flexible support members connected to and carrying the bottom plate assembly, the flexible support members having bottom and top end portions, the bottom end portions being attached to opposing sides of the bottom plate segments with the barrier segments retained therebetween;

a drive system with a rotatable drive shaft assembly comprising a plurality of drive shaft segments with the housing segments and a plurality of spools attached to each drive shaft segment, each spool being connected to a respective one of the flexible support members and configured to wind the flexible support member onto the spool when the drive shaft segment is rotated in a first direction causing the barrier assembly to move toward the stowed position and configured to unwind the flexible support member from the spool when the drive shaft segments are rotated in a second direction causing the barrier assembly to move toward the deployed position;

a control system operationally connected to the drive system and configured to control the drive system for movement of the barrier assembly between the deployed and stowed positions; and a plurality of motion sensor assemblies attached to the top surfaces of the bottom plate segments, the motion sensors assemblies being covered by a bottom portion of the barrier assembly supported on the bottom plate segments when the barrier assembly is in the stowed position and the intermediate position, the motion sensors being sealably enclosed in a fireproof material, the motion sensor assemblies having a plurality of motion sensors, and at least a portion of the motion sensor assemblies have microcontrollers connected to the motion sensors and operatively connected to the controller and being configured to receive data from the motion sensors and to detect change in speed, motion, and/or angular orientation of any portion of the corresponding bottom plate segment in the event the bottom plate segment impacts an obstruction as the bottom plate segments move with the barrier assembly between the stowed, intermediate and deployed positions, the motion sensors provide one or more sensor signals for use by the control system indicating a change in the bottom plate segment's motion, wherein the controller controls the drive system as a function of the sensor signals to control movement of the vapor barrier between the stowed, intermediate and deployed positions.

20. The assembly of claim 19 wherein the motion sensors are accelerometers.

* * * * *